US009268256B2

(12) United States Patent
Nakane et al.

(10) Patent No.: US 9,268,256 B2
(45) Date of Patent: Feb. 23, 2016

(54) IMAGE FORMING APPARATUS

(71) Applicant: Konica Minolta, Inc., Chiyoda-ku, Tokyo (JP)

(72) Inventors: Yoshiki Nakane, Toyokawa (JP); Tsugihito Yoshiyama, Toyohashi (JP); Yohei Ito, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/751,805

(22) Filed: Jun. 26, 2015

(65) Prior Publication Data

US 2016/0004183 A1 Jan. 7, 2016

(30) Foreign Application Priority Data

Jul. 1, 2014 (JP) ..... 2014-135804

(51) Int. Cl.
*G03G 15/01* (2006.01)
*G03G 15/08* (2006.01)
*G03G 15/00* (2006.01)

(52) U.S. Cl.
CPC ..... *G03G 15/0831* (2013.01); *G03G 15/5033* (2013.01)

(58) Field of Classification Search
CPC ..... G03G 15/0831; G03G 15/5033
USPC ..... 399/49, 72, 299, 301, 394
See application file for complete search history.

(56) References Cited

U.S. PATENT DOCUMENTS 7,885,587 B2 * 2/2011 Matsuda et al. ..... 399/301

FOREIGN PATENT DOCUMENTS

| | | |
|---|---|---|
| JP | 2006-139111 A | 6/2006 |
| JP | 2008-225240 A | 9/2008 |
| JP | 2009-058732 A | 3/2009 |

* cited by examiner

*Primary Examiner* — Hoang Ngo
(74) *Attorney, Agent, or Firm* — Buchanan Ingersoll & Rooney PC

(57) ABSTRACT

In an image forming apparatus, when some of a plurality of image supporters which are preceded by another image supporter on an upstream side of the carrying direction are referred to as downstream side image supporters, a control section derives a toner supply amount for each of positions in a main-scanning direction for each of downstream side image supporters based on image data for the downstream side image supporters and image data for an upstream side image supporter, and thereafter generates patch image data that represents the derived toner supply amount, and the exposure section further scans each of the downstream side image supporters in the main-scanning direction with an optical beam modulated according to the patch image data generated by the control section.

5 Claims, 9 Drawing Sheets

IMAGE FORMING APPARATUS

This application is based on Japanese Patent Application No. 2014-135804 filed on Jul. 1, 2014, the content of which is incorporated herein by reference.

BACKGROUND OF THE INVENTION

1. Field of the Invention

The present invention relates to an image forming apparatus which employs an electrophotographic system and a tandem system.

2. Description of Related Art

In the electrophotographic system, a charged image supporter is irradiated with modulated light, whereby a latent image is formed. This latent image is developed with a toner, whereby a toner image is formed. The toner image is transferred from the image supporter to a transfer medium.

In the tandem system, image supporters are provided in a casing for respective ones of a plurality of colors (e.g., Y (yellow), M (magenta), C (cyan), K (black)). These image supporters are arranged in parallel along a predetermined carrying direction. On these image supporters, toner images of corresponding colors are concurrently formed. The toner images are transferred to an intermediate transfer medium such that the toner images are superposed on one another, whereby a full-color composite toner image is formed. The composite toner image, which is supported on the intermediate transfer medium, is carried in the carrying direction.

In an image forming apparatus which employs both of the above-described systems, toners and the like remain on the surfaces of the image supporters after transfer of the toner images from the image supporters to the intermediate transfer medium. The image forming apparatus includes a cleaning member configured to remove the transfer residual toners and other deposits from the image supporter surfaces. The cleaning member is, for example, a cleaning blade which is configured to touch the surface of the image supporters and mechanically remove the transfer residual toners and the like.

In recent years, to reduce the downtime of the image forming apparatus, extension of the life of the image supporters and the cleaning member (hereinafter, "the image supporters and other members") has been demanded. A bottleneck in the life extension is the abrasion loss of the image supporters and other members. The image supporters and other members are to be replaced by new ones when the abrasion loss exceeds a predetermined threshold. Therefore, the life extension requires suppressing abrasion of the image supporters and other members. To this end, the technique of forming a coating of a solid lubricant (hereinafter, "lubricant") over the surface of the image supporters has been put into practice. According to this technique, smoothness is given to the image supporter surface, so that the frictional force between the image supporter surface and the cleaning member is reduced, whereby abrasion of these components is suppressed.

However, the lubricant coating is abraded when the transfer residual toner reaches a gap between the image supporters and the cleaning member. Therefore, the thickness of the lubricant coating is different between an image portion in which the toner adheres to the image supporter surface and a non-image portion in which no toner adheres. Due to the variation in thickness of the lubricant coating, conventional image forming apparatuses have deteriorated image quality. A specific example of this problem is described below.

In the image forming apparatus, if transfer residual toners adhere and fix to a thin portion of the lubricant coating during continuous printing of a plurality of copies, the transfer residual toners sometimes cannot be removed from the image supporter surface even using the cleaning member. In this case, a potential variation would not occur even if the toner-fixed portion is irradiated with modulated light in a subsequent exposure process. As a result, in some cases, white spot noise is produced on the copies.

In image forming apparatuses for office use which are rarely used for continuous printing of a large number of copies of the same material, the above-described deterioration in the image quality has not been considered as a critical problem. However, this has been considered as a major problem in the field of industrial printing because a large number of copies of the same material are continuously printed and/or the required image quality level is high.

In view of the above problem, Japanese Patent Laid-Open Publication No. 2009-58732 discloses the technique of applying a lubricant to an image supporter while controlling exposure and a bias voltage which is to be applied to a lubricant application brush according to image formation history information. Meanwhile, Japanese Patent Laid-Open Publication No. 2008-225240 discloses the technique of forcibly consuming toners according to the number of printed pixels in the main-scanning direction of the image supporter.

However, in an image forming apparatus which employs the electrophotographic and tandem systems, toners are reversely transferred via an intermediate transfer medium as well known in the art. The reverse transfer means that, relative to a certain image supporter, a toner transferred from an image supporter on the upstream side of a carrying direction of a toner image to an intermediate transfer medium is transferred to a surface of an image supporter on the downstream side. Due to the reversely transferred toner, the amount of toner that reaches a gap between the image supporter and the cleaning member increases. However, since the increase of the toner amount which is attributed to the reversely transferred toner is not considered in the techniques disclosed in Japanese Patent Laid-Open Publications Nos. 2009-58732 and 2008-225240, there is a probability that a relatively large amount of toner adheres to the image supporter surface. As a result, there is a problem that the toner fixes onto the lubricant coating so that the image quality can deteriorate.

In view of the above, an object of the present invention is to provide an image forming apparatus that is capable of suppressing deterioration of the image quality which is attributed to a reversely transferred toner.

SUMMARY OF THE INVENTION

One aspect of the present invention is an image forming apparatus having: a plurality of image supporters arranged in parallel along a predetermined carrying direction, each of the image supporters being rotatable in a sub-scanning direction; a plurality of chargers configured to charge the plurality of image supporters; an exposure section configured to scan the plurality of image supporters with an optical beam modulated according to image data that represents a print image in a main-scanning direction that is generally perpendicular to the sub-scanning direction, thereby forming a latent image; a plurality of developing sections configured to supply a toner to the plurality of image supporters to form toner images; a plurality of lubricant supplying sections configured to supply a lubricant to the plurality of image supporters; an intermediate transfer medium extending in the carrying direction, to which the toner images formed on the plurality of image supporters are transferred such that the toner images are superposed on one another; a plurality of cleaning members configured to remove a transfer residual toner remaining on the plurality of image supporters after the transfer of the toner images to the intermediate transfer medium; and a control section configured to control formation of the toner images that represent the print image.

In the above-described image forming apparatus, when some of the plurality of image supporters which are preceded by another image supporter on an upstream side of the carrying direction are referred to as downstream side image supporters, the control section further derives a toner supply amount for each of positions in the main-scanning direction for each of the downstream side image supporters based on image data for the downstream side image supporters and image data for an upstream side image supporter, and thereafter generates patch image data that represents the derived toner supply amount, and the exposure section further scans each of the downstream side image supporters in the main-scanning direction with an optical beam modulated according to the patch image data generated by the control section.

DETAILED DESCRIPTION OF THE PREFERRED EMBODIMENTS

Figure 1:
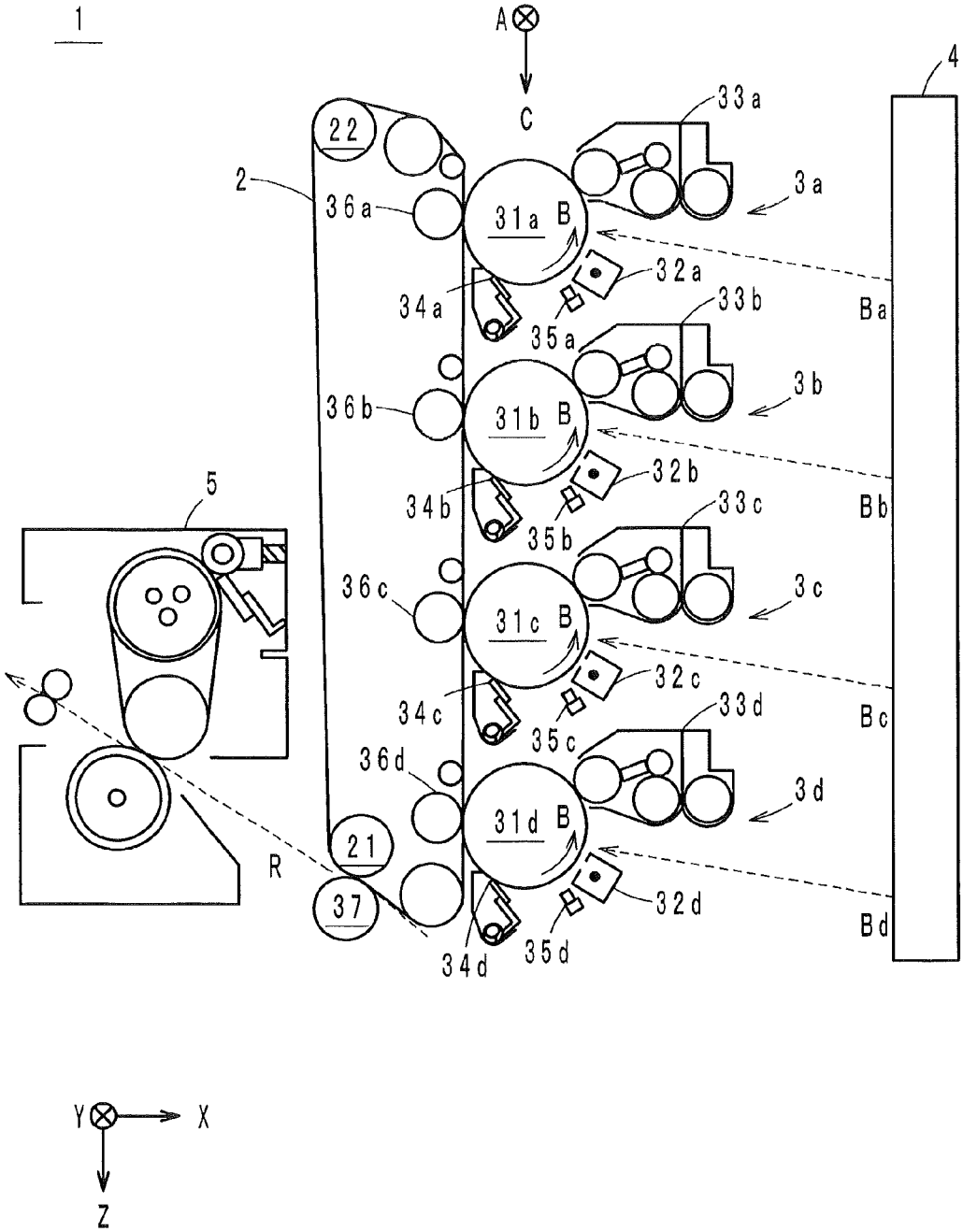
FIG. 1 is a block diagram showing the configuration of an image forming apparatus of one embodiment.

Hereinafter, an image forming apparatus of one embodiment is described with reference to the drawings.

DEFINITION

The X-axis, Y-axis and Z-axis directions shown in the drawings are generally perpendicular to one another. The X-axis represents a direction from the left to the right of the image forming apparatus 1. The Y-axis represents a direction from the front to the rear of the apparatus 1. The Z-axis represents a direction from the top to the bottom of the apparatus 1.

The A-axis represents both a direction generally parallel to the rotation axis of a photoreceptor drum 31 and the main-scanning direction A in which an exposure section 4 moves an optical beam for scanning. The arrow B represents both the direction B in which the photoreceptor drum 31 rotates and the sub-scanning direction B that is generally perpendicular to the main-scanning direction A. The C-axis represents the carrying direction C in which a toner image transferred to an intermediate transfer belt 2 is carried. In the present embodiment, for convenience of illustration, the A-axis is in the same direction as the Y-axis, and the C-axis is in the same direction as the Z-axis.

In the specification and drawings, some of the reference numerals are suffixed with lowercase alphabets, a, b, c and d. These suffixes a, b, c and d represent yellow (Y), magenta (M), cyan (C) and black (K), respectively. For example, a photoreceptor drum 31*a* means a photoreceptor drum of yellow (Y).

General Configuration and Operation of Image Forming Apparatus

In FIG. 1, the image forming apparatus 1 is, for example, a tandem-type full-color MFP (Multifunction Peripheral) which employs an electrophotographic system. In the image forming apparatus 1, the intermediate transfer belt 2 is wrapped around the perimeter surfaces of a roller 21, a tension roller 22, and other elements, which are arranged along a generally vertical direction, and is rotatable clockwise, for example.

On the right side of the intermediate transfer belt 2, imaging units 3*a* to 3*d* are arranged in parallel along the carrying direction C, i.e., in this order from the top to the bottom. The imaging units 3*a* to 3*d* have photoreceptor drums 31*a* to 31*d*, each of which is an example of the image supporter. The photoreceptor drums 31*a* to 31*d* have a cylindrical shape elongated in the main-scanning direction A and are rotatable in the direction of the arrow B, for example, around the center axis that is generally parallel to the main-scanning direction A. The photoreceptor drums 31*a* to 31*d* are arranged in parallel along the carrying direction C so as to be in contact with the outside perimeter surface of the intermediate transfer belt 2 at its right side.

As well known in the art, chargers 32*a* to 32*d*, developing sections 33*a* to 33*d*, cleaning members 34*a* to 34*d*, and dischargers 35*a* to 35*d* are provided around the photoreceptor drums 31*a* to 31*d*, from the upstream side to the downstream side of the rotation direction B.

Further, primary transfer rollers 36*a* to 36*d* are provided at positions opposite to the photoreceptor drums 31*a* to 31*d* with the intermediate transfer belt 2 interposed therebetween. The primary transfer rollers 36*a* to 36*d* push the inside perimeter surface of the intermediate transfer belt 2 to the right, thereby forming a primary transfer area in a portion where each of the photoreceptor drums 31*a* to 31*d* and the intermediate transfer belt 2 are in contact with each other.

Further, a secondary transfer roller 37 is provided at a position opposite to the roller 21 with the intermediate transfer belt 2 interposed therebetween. The secondary transfer roller 37 pushes the outside perimeter surface of the intermediate transfer belt 2 toward the roller 21, thereby forming a secondary transfer area in a portion where the secondary transfer roller 37 and the intermediate transfer belt 2 are in contact with each other.

Further, the exposure section 4 is provided on the right side of the imaging units 3*a* to 3*d*.

The image forming apparatus 1 further includes a supply cassette loaded with printable sheets (e.g., paper or OHP sheets), although not shown. The sheets are fed into a sheet path R, which is represented by a broken line arrow, in a one-by-one manner by a feed roller included in the supply cassette. In this sheet path R, the secondary transfer area and a fixing section 5 are provided.

Next, a general operation of the image forming apparatus 1 that has the above-described configuration is described.

In the image forming apparatus 1, the chargers 32*a* to 32*d* uniformly negatively charge the perimeter surfaces of the photoreceptor drums 31*a* to 31*d* rotating in the direction of the arrow B. The exposure section 4 receives image data (more specifically, bit map data) of each color of YMCK. The exposure section 4 scans the charged perimeter surfaces of the rotating photoreceptor drums 31*a* to 31*d* in the main-scanning direction A with optical beams Ba to Bd whose intensities are modulated according to the received image data (exposure). As a result, electrostatic latent images of corresponding colors are formed on the perimeter surfaces of the photoreceptor drums 31*a* to 31*d*. Specifically, at the perimeter surfaces of the photoreceptor drums 31*a* to 31*d*, the absolute value of the potential decreases in portions irradiated with the optical beams Ba to Bd. The thus-irradiated portions constitute the image portions in the electrostatic latent image while non-irradiated portions constitute the non-image portions.

The developing sections 33*a* to 33*d* contain a two-component developer to which a lubricant is externally added. The lubricant may be made of microparticles of an inorganic stearate compound, such as zinc stearate or aluminum stearate, for example. The developing sections 33*a* to 33*d* supply toners negatively charged by friction to the electrostatic latent images formed on the photoreceptor drums 31*a* to 31*d* such that the toners of corresponding colors adhere to the image portions of the electrostatic latent images, thereby forming toner images. The lubricant is supplied by the developing sections 33*a* to 33*d*, together with the toners, to the perimeter surfaces of the photoreceptor drums 31*a* to 31*d*. As described herein, in the present embodiment, the developing sections 33*a* to 33*d* also serve as the lubricant supplying sections.

The toner images formed on the photoreceptor drums 31*a* to 31*d* are sequentially transferred to the same area on the intermediate transfer belt 2 in a corresponding primary transfer area (primary transfer), whereby a full-color composite toner image is formed. The composite toner image, which is supported on the intermediate transfer belt 2, is carried in the carrying direction C toward the secondary transfer area.

A sheet output from the supply cassette is introduced to this secondary transfer area. In the secondary transfer area, the roller 21 and the secondary transfer roller 37 function to transfer the composite toner image from the intermediate transfer belt 2 to the sheet (secondary transfer) and forward the resultant sheet to the fixing section 5 that is provided on the downstream side in the sheet path R. The fixing section 5 fixes the composite toner image on the sheet forwarded from the secondary transfer area, thereby producing a printed material. The printed material is finally ejected onto an unshown ejection tray.

As well known in the art, the toners sometimes fail to be transferred to the intermediate transfer belt 2 and remain on the photoreceptor drums 31*a* to 31*d*. The remaining toners are carried to the cleaning members 34*a* to 34*d* by the rotation of the photoreceptor drums 31*a* to 31*d*. The cleaning members 34*a* to 34*d* are provided on the downstream side of the rotation direction B relative to the corresponding primary transfer areas and are configured to mechanically scrape away the transfer residual toners from the perimeter surfaces of the photoreceptor drums 31*a* to 31*d* (cleaning) and even a lubricant on the perimeter surfaces to form a lubricant coating.

Further, the dischargers 35*a* to 35*d* are provided on the downstream side of the rotation direction B relative to the cleaning members 34*a* to 34*d*. The dischargers 35*a* to 35*d* expose the entire surfaces of the photoreceptor drums 31*a* to 31*d* to light, thereby decreasing the absolute value of the potential remaining on the perimeter surfaces such that the image history (memory image) of the present cycle would not remain.

Outlines of Patch Image

The developing sections 33*a* to 33*d* include, more specifically, a developer tank and a developer sleeve. The developer tank contains a two-component developer which includes a toner and a carrier and to which external additives, including the above-described lubricant, are added. The developer sleeve is arranged so as to oppose corresponding one of the photoreceptor drums 31*a* to 31*d* and is rotatable around an incorporated magnetic pole. This enables to carry the toner from the developer tank to the perimeter surface of corresponding one of the photoreceptor drums 31*a* to 31*d*.

In each developer tank, a screw is provided for stirring the carrier and the toner. When replenished with the toner of a corresponding color, each screw mixes the toner and the carrier in the developer tank such that the toner has a predetermined charge amount. However, if an image to be printed is a low-coverage image, the consumption of the toner is small, and therefore, the toner in the developer tank is stirred by the screw for a long time. As a result, the external additives fall off from or sink into the toner surface, and hence, there is a problem that the charge amount of the toner decreases. To solve this problem, in conventional image forming apparatuses, in the case where low-coverage images are continuously printed, a patch image is formed between two consecutive images (i.e., in an image interval) such that the toner is forcibly consumed, whereby the charge amount of the toner is maintained.

Reversely Transferred Toner

In the above-described image forming apparatus 1, the toner is reversely transferred from a photoreceptor drum on the upstream side of the carrying direction C to a photoreceptor drum on the downstream side. The inventors of the present application measured the weight per unit volume of the reversely transferred toner in the image forming apparatus 1 in the HH environment (temperature: 30° C., humidity: 85%). Here, for convenience of description below, variables $V_{Pa}$ to $V_{Pd}$, $V_{Ta}$ to $V_{Td}$, $V_{Rab}$ to $V_{Rad}$, $V_{Rbc}$, $V_{Rbd}$, $V_{Rcd}$, and $E_T$ are defined as shown in Table 1. The weight per unit volume of the toner is referred to as "toner amount".

TABLE 1

Definition of Respective Values

| Variables | Definition |
|---|---|
| $V_{Pa}$, $V_{Pb}$, $V_{Pc}$, $V_{Pd}$ | Toner amount supplied from developing sections 33a to 33d to photoreceptor drums 31a to 31d. |
| $V_{Ta}$, $V_{Tb}$, $V_{Tc}$, $V_{Td}$ | Toner amount of corresponding colors transferred from photoreceptor drums 31a to 31d to intermediate transfer belt 2. |
| $V_{Ba}$, $V_{Bb}$, $V_{Bc}$, $V_{Bd}$ | Toner amount of corresponding colors scraped by cleaning members 34a to 34d. |
| $V_{Rab}$ | Toner amount of yellow (Y) reversely transferred to photoreceptor drums 31b. |
| $V_{Rac}$ | Toner amount of yellow (Y) reversely transferred to photoreceptor drums 31c. |
| $V_{Rad}$ | Toner amount of yellow (Y) reversely transferred to photoreceptor drums 31d. |
| $V_{Rbc}$ | Toner amount of magenta (M) reversely transferred to photoreceptor drums 31c. |

TABLE 1-continued

| Definition of Respective Values | |
|---|---|
| Variables | Definition |
| $V_{Rbd}$ | Toner amount of magenta (M) reversely transferred to photoreeeptor drums 31d. |
| $V_{Rcd}$ | Toner amount of cyan (C) reversely transferred to photoreceptor drums 31d. |
| $E_T$ | Percentage of $V_{Ta}$, $V_{Tb}$, $V_{Tc}$, $V_{Td}$ to $V_{Pa}$, $V_{Pb}$, $V_{Pb}$, $V_{Pd}$. |

In the image forming apparatus 1 of the present embodiment, the transfer efficiency $E_T$ for each color is about 90%. Therefore, the remnant toner of about 10% fails to be transferred to the intermediate transfer belt 2 and scraped away by the cleaning members 34*a* to 34*d*. Here, the reversely transferred toner from the photoreceptor drum on the upstream side also reaches the cleaning members 34*b* to 34*d* and is scraped away. According to the measurement carried out by the inventors of the present application, as seen from Table 2 below, when $V_{Pa}$ was 5.00 [g/m$^2$], for example, $V_{Ta}$ was 4.50 [g/m$^2$], and the transfer residual toner amount was $V_{Ba}$ (=$V_{Pa}$−$V_{Ta}$≈0.50 [g/m$^2$]). On the cleaning member 34*b* for magenta (M), the reversely transferred toner of yellow (Y) of $V_{Rab}$ (≈0.17 [g/m$^2$]) was detected. On the cleaning member 34*c* for cyan (C), the reversely transferred toner of yellow (Y) of $V_{Rac}$ (≈0.06 [g/m$^2$]) was detected. On the cleaning member 34*d* for black (K), the reversely transferred toner of yellow (Y) of $V_{Rad}$ (≈0.02 [g/m$^2$]) was detected. Hereinabove, the toner amount of the reversely transferred toner from the photoreceptor drum 31*a* of yellow (Y) to the photoreceptor drums 31*b* to 31*d* on the downstream side has been described. The toner amounts from the photoreceptor drums 31*b*, 31*c* for magenta (M) and cyan (C) to the photoreceptor drums on the downstream side are as shown in Table 3 and Table 4.

TABLE 2

| Reversely Transferred Toner Amount of Yellow (Y) | | | | | |
|---|---|---|---|---|---|
| $V_{Pa}$ [g/m$^2$] | $V_{Ta}$ [g/m$^2$] | $V_{Ba}$ [g/m$^2$] | $V_{Rab}$ [g/m$^2$] | $V_{Rac}$ [g/m$^2$] | $V_{Rad}$ [g/m$^2$] |
| 5.00 | 4.50 | 0.50 | 0.17 (≈$V_{Ba}/3^1$) | 0.06 (≈$V_{Ba}/3^2$) | 0.02 (≈$V_{Ba}/3^3$) |

TABLE 3

| Reversely Transferred Toner Amount of Magenta (M) | | | | |
|---|---|---|---|---|
| $V_{Pb}$ [g/m$^2$] | $V_{Tb}$ [g/m$^2$] | $V_{Bb}$ [g/m$^2$] | $V_{Rbc}$ [g/m$^2$] | $V_{Rbd}$ [g/m$^2$] |
| 5.00 | 4.50 | 0.50 | 0.17 (≈$V_{Bb}/3^1$) | 0.06 (≈$V_{Bb}/3^2$) |

TABLE 4

| Reversely Transferred Toner Amount of Cyan (C) | | | |
|---|---|---|---|
| $V_{Pb}$ [g/m$^2$] | $V_{Tb}$ [g/m$^2$] | $V_{Bb}$ [g/m$^2$] | $V_{Rcd}$ [g/m$^2$] |
| 5.00 | 4.50 | 0.50 | 0.17 (≈$V_{Bb}/3^1$) |

Figure 2:
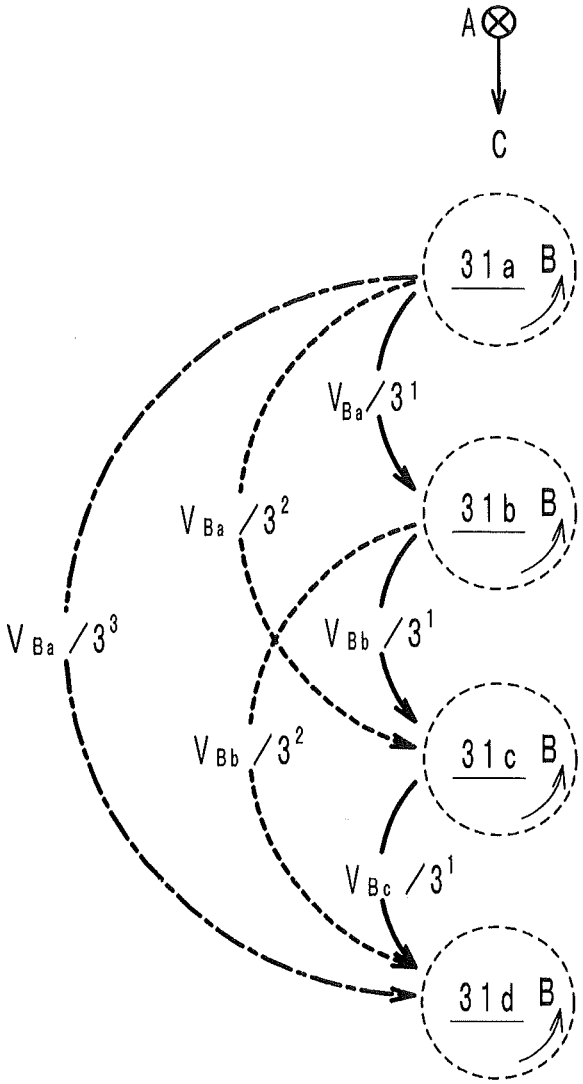
FIG. 2 is a schematic diagram showing the state of reversely transferred toner and the reversely transferred toner amount.

According to the simulation carried out by the inventors of the present application, it was found that, as seen from FIG. 2, the reversely transferred toners in the amount of about $V_{Ba}/3^3$, about $V_{Bb}/3^2$, and about $V_{Bc}/3^1$ adhere to the photoreceptor drum 31*d*, the reversely transferred toners in the amount of about $V_{Ba}/3^2$ and about $V_{Bb}/3^1$ adhere to the photoreceptor drum 31*c*, and the reversely transferred toner in the amount of about $V_{Ba}/3^1$ adheres to the photoreceptor drum 31*b*. Here, in each of the reversely transferred toner amounts, the denominator is a parameter α which varies depending on the conditions such as ambient temperature and ambient humidity, and therefore, the total reversely transferred toner amount $V_{Rb}$ adhering onto the photoreceptor drum 31*b* can be generalized using a predetermined parameter α as shown in Formula (1). Likewise, the total reversely transferred toner amounts $V_{Rc}$ and $V_{Rd}$ adhering onto the photoreceptor drums 31*c* and 31*d* are generalized using the parameter α as shown in Formulae (2) and (3).

$$V_{Rb} \approx V_{Ba}/\alpha^1 \quad (1)$$

$$V_{Rc} \approx V_{Ba}/\alpha^2 + V_{Bb}/\alpha^1 \quad (2)$$

$$V_{Rd} \approx V_{Ba}/\alpha^3 + V_{Bb}/\alpha^2 + V_{Bc}/\alpha^1 \quad (3)$$

Details of Technical Problems

As well known in the art, the cleaning members 34*a* to 34*d* are typically realized by processing a polyurethane rubber into a sheet shape and arranged on the perimeter surfaces of the photoreceptor drums 31*a* to 31*d* so as to be in contact with the perimeter surfaces generally in parallel to the main-scanning direction A. During rotation of the photoreceptor drums 31*a* to 31*d*, a frictional force occurs between the photoreceptor drums 31*a* to 31*d* and the cleaning members 34*a* to 34*d*. This frictional force causes elastic deformation of the cleaning members 34*a* to 34*d*. In this case, the edge portions of the cleaning members 34*a* to 34*d* are in contact with the perimeter surfaces of the photoreceptor drums 31*a* to 31*d* with the elasticity and the frictional force being in equilibrium. In such a state, the transfer residual toners and the reversely transferred toners adhering onto the perimeter surfaces of the photoreceptor drums 31*a* to 31*d* are scraped away when reaching the cleaning members 34*a* to 34*d*. However, when the toner amount on the perimeter surfaces is large, puddles (i.e., a stationary layer) of the external additives formed in the cleaning members 34*a* to 34*d* are pushed out by the plunging force of the toners so that the amount of external additives and toners passing through nip portions between the photoreceptor drums 31*a* to 31*d* and the cleaning members 34*a* to 34*d* increase. When the external additives pass through the nip portions, the pressing force from the cleaning blades 34*a* to 34*d* is exerted on the external additives, so that the lubricant coating over the surfaces of the photoreceptor drums 31*a* to 31*d* is abraded away. Particularly, in the field of industrial printing, a large number of copies of the same material are continuously printed in many cases. Therefore, even in the case where a low-coverage image is printed, the transfer residual toners and the reversely transferred toners are more likely to adhere to the same position in the main-scanning direction A on the drums 31*a* to 31*d*, so that thickness variation of the lubricant coating is more likely to occur in the main-scanning direction A. In this situation, if a patch image whose toner amount is uniform in the main-scanning direction A is formed on the perimeter surfaces of the photoreceptor drums 31*a* to 31*d* as in the conventional apparatuses, there is a probability that an originally thin portion of the lubricant coating becomes thinner. As a result, deterioration of the image quality which is attributed to white spots or the like is more likely to occur. In consideration of this point, in the image forming apparatus 1 of the present embodiment, a patch image such as described in the following section is formed for the purpose of suppressing decrease of the charge amount of the toner and variation in thickness of the lubricant coating.

Generation of Patch Image

Figure 3:
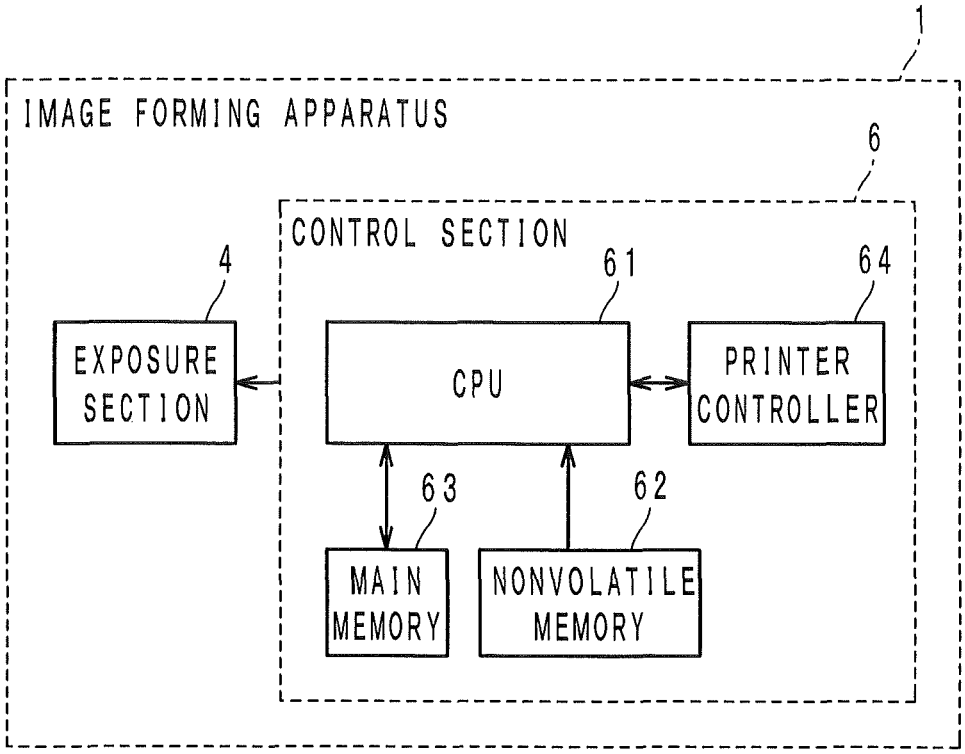
FIG. 3 is a block diagram showing a major part of the image forming apparatus of FIG. 1.

FIG. 3 is a block diagram showing a major part of the image forming apparatus 1 of FIG. 1. FIG. 3 shows a control section 6 as a major part of the image forming apparatus 1 in addition to the exposure section 4. The control section 6 includes a CPU 61, a nonvolatile memory 62, a main memory 63, and a printer controller 64. The CPU 61 executes a program stored beforehand in the nonvolatile memory 62 using the main memory 63 as a work area, thereby controlling formation of print images and patch images. Hereinafter, the operation of the control section 6 is described with reference to FIG. 4.

Figure 4:
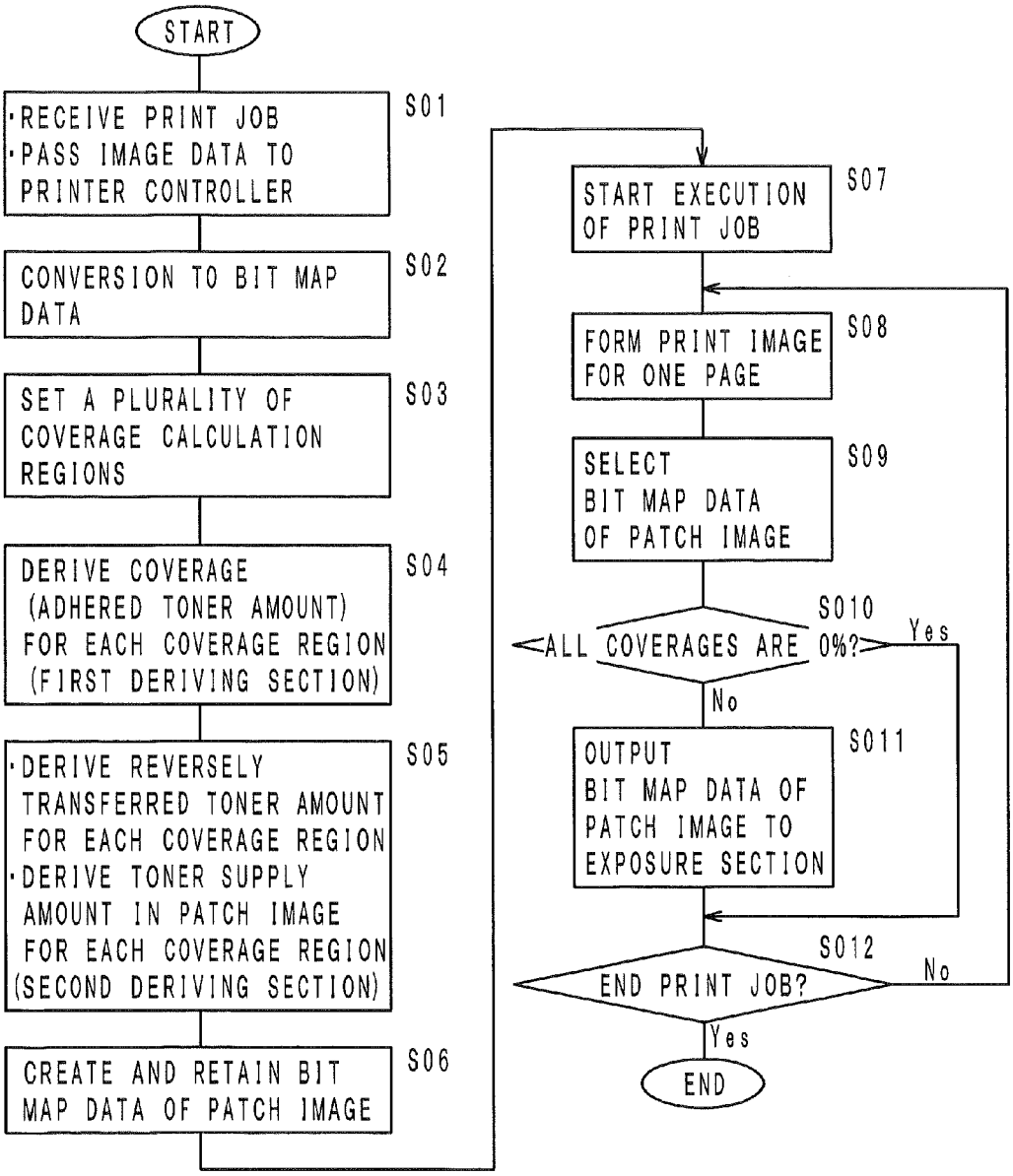
FIG. 4 is a flowchart showing an operation procedure of the CPU of FIG. 3.

In FIG. 4, when receiving a print job, the CPU 61 passes image data to the printer controller 64 (S01). The print job includes, for example, image data which represents a plurality of images to be continuously printed.

When receiving the image data from the CPU 61, the printer controller 64 creates bit map data of each color of YMCK for every one of the images to be printed (S02). As well known in the art, the exposure section 4 scans the perimeter surfaces of the photoreceptor drums 31*a* to 31*d* rotating in the sub-scanning direction B with the optical beams Ba to Bd in the main-scanning direction A. Here, the intensity of the optical beams Ba to Bd is modulated according to the image data, so that a latent image consisting of image portions and non-image portions is formed on the perimeter surfaces of the photoreceptor drums 31*a* to 31*d*. Each bit map data indicates whether an image portion or a non-image portion is to be formed at every one of the dot positions that are specified by the position in the main-scanning direction A and the position in the sub-scanning direction B. In the present embodiment, ON means an image portion and OFF means a non-image portion (see FIG. 5), although this is exemplary.

Figure 5:
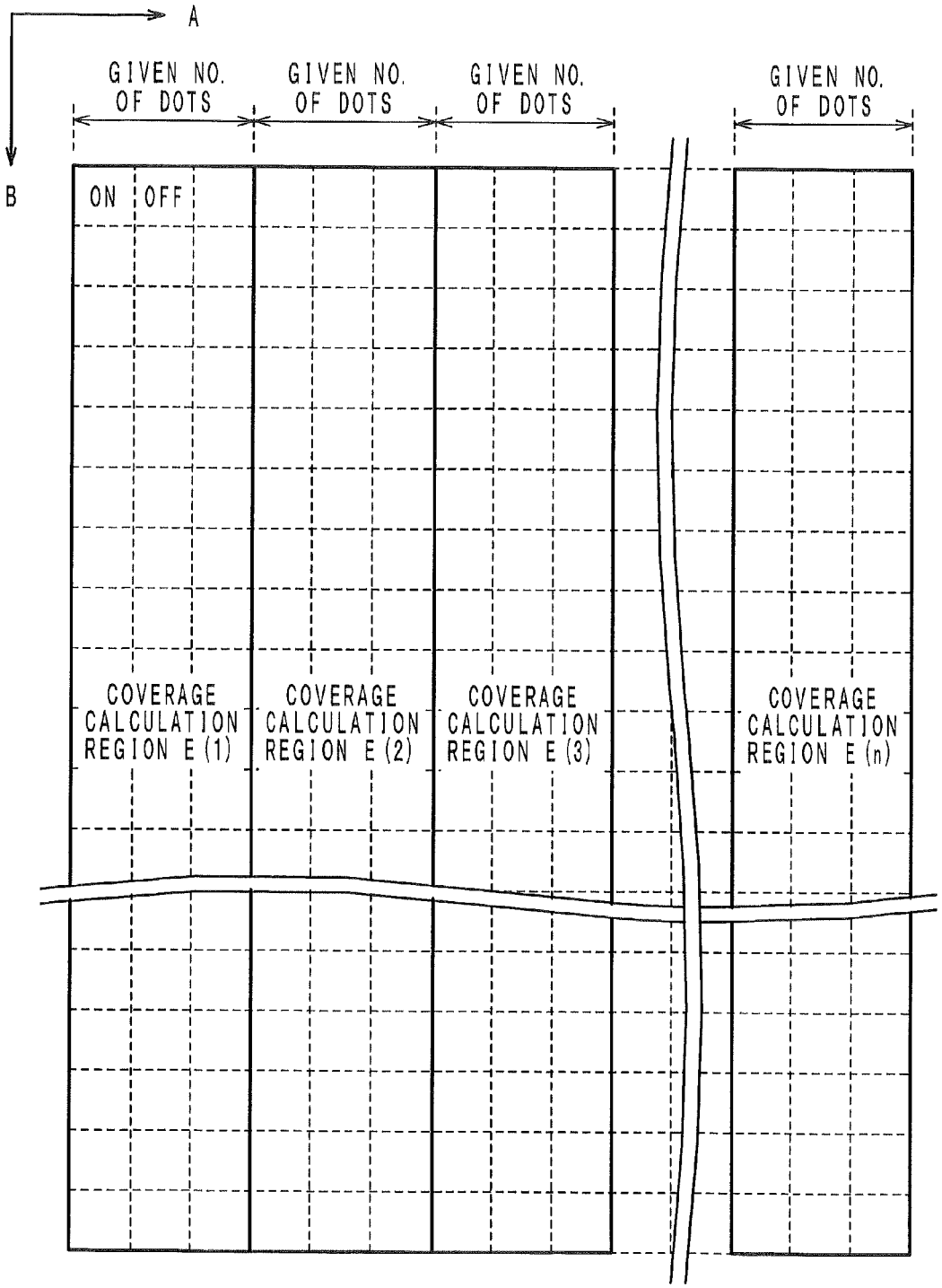
FIG. 5 is a schematic diagram showing coverage calculation regions.

After completing creation of the bit map data in the printer controller 64, the CPU 61 divides each bit map data by a predetermined number of dots in the main-scanning direction A to set a plurality of coverage calculation regions E(1) to E(n) (n is an integer not less than 2) (S03). FIG. 5 shows an example of the coverage calculation regions E(1) to E(3), . . . , E(n).

Then, the CPU 61 counts the number of dots of the image portions in each of the coverage calculation regions E(1) to E(n) in each bit map data. Thereafter, the CPU 61 derives the coverage for each of the coverage calculation regions E(1) to E(n) (S04). Here, the coverage refers to the ratio of the number of dots of the image portions to the total dot number in each coverage calculation region, and represents the adhered toner amount for each of positions in the main-scanning direction for toner images obtained by color separation of the print image into YMCK. Table 5 below shows an example of the calculation results obtained at S04 for one print image.

TABLE 5

| Reversely Transferred Toner Amount of Magenta (M) | | | | |
|---|---|---|---|---|
| $V_{Pb}$ [g/m$^2$] | $V_{Tb}$ [g/m$^2$] | $V_{Bb}$ [g/m$^2$] | $V_{Rbc}$ [g/m$^2$] | $V_{Rbd}$ [g/m$^2$] |
| 5.00 | 4.50 | 0.50 | 0.17 ($\approx V_{Bb}/3^1$) | 0.06 ($\approx V_{Bb}/3^2$) |

As previously described, if the coverage of the print image is excessively low, the toner charge amount decreases. Therefore, the image forming apparatus 1 also forms a patch image to forcibly consume the toner. In the present embodiment, it is assumed that, to maintain a necessary toner charge amount, as for yellow (Y) at the most upstream position in the carrying direction C, the sum of the coverage of the print image and the coverage of the patch image needs to satisfy a predetermined reference coverage β. As for each color of MCK preceded by a photoreceptor drum on the upstream side of the carrying direction C, it is assumed that the sum of the coverage of the print image, the amount of the reversely transferred toner from the photoreceptor drum on the upstream side, and the coverage of the patch image needs to satisfy the predetermined reference coverage β. This reference coverage β is also a parameter which varies depending on the conditions such as ambient temperature and ambient humidity, as does the parameter α. However, in the case of printing on an A4-size plain paper sheet in a transverse direction in the HH environment, the reference coverage β is 5 [%/sheet].

Then, the CPU 61 derives the reversely transferred toner amount for each of the coverage calculation regions of each bit map data of the MCK colors, i.e., exclusive of yellow (Y), and meanwhile derives the coverage (i.e., the toner amount to be supplied) $V_{Ca}(i)$, $V_{cb}(i)$, $V_{Cc}(i)$, $V_{Cd}(i)$ for each of the coverage calculation regions in the patch image of each color of YMCK (S05). Note that $V_{Ca}(i)$, $V_{cb}(i)$, $V_{Cc}(i)$, and $V_{Cd}(i)$ are integers not less than 0, and the lower limit value is 0.

More specifically, the CPU 61 derives the toner amount for the patch image of yellow (Y) using Formula (4) shown below. The CPU 61 derives the toner amounts for the patch images of the MCK colors using Formulae (5) to (7) shown below. Here, for example, in Formula (5), $E_b(i)$ is the coverage of the print image of the photoreceptor drum 31*b* of magenta (M), and $(E_a(i)+V_{Ca}(i))/\alpha$ is the amount of the reversely transferred toner from the immediately-previous photoreceptor drum 31*a* on the upstream side.

$$V_{Ca}(i)=\beta-E_a(i) \tag{4}$$

$$V_{Cb}(i)=\beta-(E_b(i)+(E_a(i)+V_{Ca}(i))/\alpha) \tag{5}$$

$$V_{Cc}(i)=\beta-(E_c(i)+(E_b(i)+V_{Cb}(i))/\alpha+(E_a(i)+V_{Ca}(i))/\alpha^2) \tag{6}$$

$$V_{Cd}(i)=\beta-(E_d(i)+(E_c(i)+V_{Ca}(i))/\alpha+(E_b(i)+V_{Cb}(i))/\alpha^2+(E_a(i)+V_{Cc}(i))/\alpha^3) \tag{7}$$

In Formulae (4) to (7), i is 1, 2, . . . n. $E_a(i)$ is the coverage of yellow (Y) in the coverage calculation region E(i). Likewise, $E_b(i)$, $E_c(i)$, and $E_d(i)$ are the coverages of magenta (M), cyan (C), and black (K) in the coverage calculation region E(i).

Table 6 shown below corresponds to Table 5 shown above and shows an example of the results of the calculation at S05.

TABLE 6

Coverage Calculation Results For Each Calculation Region (Patch Image)

| | | Coverage Calculation Region | | | | | | | | |
|---|---|---|---|---|---|---|---|---|---|---|
| | | E(1) | E(2) | E(3) | E(4) | E(5) | E(6) | E(7) | . . . | E(n) |
| Patch Image | Y | 5% | 5% | 0% | 0% | 5% | 0% | 2% | . . . | 5% |
| | M | 3.33% | 3.33% | 0% | 0% | 3.33% | 0% | 0.33% | . . . | 3.33% |
| | C | 3.33% | 3.33% | 2.78% | 2.78% | 3.33% | 0.56% | 3.33% | . . . | 3.33% |
| | K | 0% | 3.33% | 0% | 3.33% | 3.33% | 0.33% | 3.33% | . . . | 3.33% |

Figure 6:
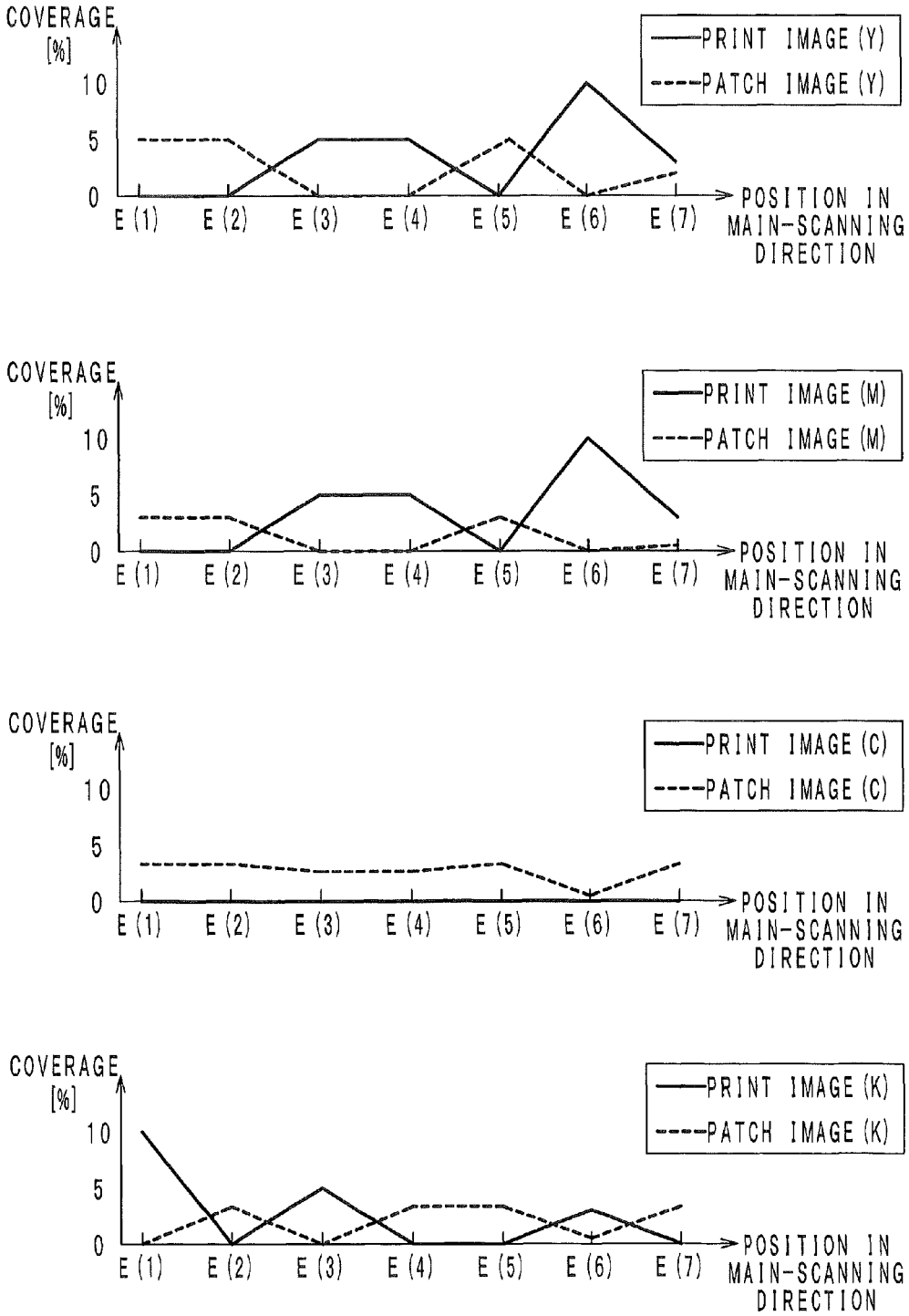
FIG. 6 shows graphs that illustrate the coverage in the main-scanning direction for a print image and a patch image of each color.

Now, refer to FIG. 6. In the uppermost part of FIG. 6, as for yellow (Y), the calculation result of the adhered toner amount (i.e., coverage) in the main-scanning direction A of the print image (i.e., the coverage calculation regions E(1) to E(n)) is shown by a graph of a solid line, and the calculation result of the toner supply amount (i.e., coverage) in the main-scanning direction A of the patch image (i.e., the coverage calculation regions E(1) to E(n)) is shown by a graph of a broken line. The toner supply amount of the patch image increases when the adhered toner amount of the print image is small at the position in the main-scanning direction A, and decreases in the opposite case. That is, the toner supply amount in the main-scanning direction A in the patch image has a generally inverse correlation with the adhered toner amount in the main-scanning direction A of the print image. Note that FIG. 6 also shows the same graphs of magenta (M), cyan (C), and black (K) as those of yellow (Y).

After completion of S05, the CPU 61 creates and retains bit map data which represents patch images of YMCK corresponding to each print image based on the calculation results of S05 (S06). Here, the length in the main-scanning direction A of the patch image is substantially equal to the length in the main-scanning direction A of the print image. Meanwhile, the width in the sub-scanning direction B of the patch image only needs to be at least equal to the length in the rotation direction B of the perimeter surfaces of the photoreceptor drums 31*a* to 31*d*.

Then, the CPU 61 starts execution of a print job (S07) and controls the components of the image forming apparatus 1 to form print images in a one-by-one manner (S08). After S07, the CPU 61 selects bit map data of patch images corresponding to the print images formed at S08 (S09) and determines whether or not their coverages are all 0% (S010). If Yes, S011 is skipped, and S012 is executed.

Alternatively, if No at S010, the CPU 61 outputs the bit map data of respective colors selected at S09 to the exposure section 4 (S011). Accordingly, the exposure section 4 produces the optical beams Ba to Bd which are modulated according to the input data of the respective colors and emits the produced optical beams onto the perimeter surfaces of the photoreceptor drums 31*a* to 31*d*. As a result, patch images of corresponding colors are formed on the photoreceptor drums 31*a* to 31*d* and thereafter transferred to the intermediate transfer belt 2. Note that, however, these patch images do not undergo the secondary transfer to a sheet but are removed away from the intermediate transfer belt 2 by a cleaner (not shown) provided on the downstream side of the secondary transfer area.

After completion of S011, the CPU 61 determines whether or not to end the print job (S012). If No, the process returns to S08. If Yes, the process of FIG. 4 is ended.

Functions and Effects of Image Forming Apparatus

As described above, according to the image forming apparatus 1 of the present embodiment, at S05 of FIG. 4, the toner supply amount in a patch image of each color is determined for each of positions in the main-scanning direction A (i.e., every coverage calculation region) in consideration of a print image formed on a corresponding photoreceptor drum and a print image formed on a photoreceptor drum on the upstream side (specifically, the amount of the reversely transferred toner from a photoreceptor drum on the upstream side). That patch image is formed subsequent to the print image, on the photoreceptor drum 31*a* to 31*b*. Here, the toner supply amount in the main-scanning direction A of the patch image has a generally inverse correlation with that of the print image. Therefore, when considering the total of the print image and the patch image, the toner amount supplied to the photoreceptor drums 31*a* to 31*d* is generally constant, and thickness variation of the lubricant coating of the photoreceptor drums 31*a* to 31*d* can be reduced. As a result, deterioration of the image quality can be prevented.

According to the image forming apparatus 1 of the present embodiment, as for yellow (Y), the adhered toner amount which is attributed to the print image is subtracted from the reference toner amount β for every coverage calculation region E(i), whereby the toner supply amount of the patch image is determined. As for the MCK colors, the amount of the reversely transferred toner from the photoreceptor drums on the upstream side is considered. Thus, the toner supply amount of the patch image is set only when the adhered toner amount, or the sum of the adhered toner amount and the reversely transferred toner amount, is smaller than the reference toner amount β. This enables to prevent decrease of the charge amount of the toner in the developer tank.

Image Quality Evaluation by Image Forming Apparatus of Present Embodiment

To confirm the effects of the present embodiment, the inventors of the present application carried out tests (first test and second test), which will be described below, using a conventional image forming apparatus and the image forming apparatus 1 of the present embodiment.

A device used for this evaluation (conventional image forming apparatus) was a bizhub C8000 manufactured by Konica Minolta Business Technologies. The printing speed of this device in the A4Y mode (A4 size: transverse) was 80 sheets/minute. The inventors of the present application reconstructed another unit as shown in FIG. 1 to realize the image forming apparatus 1. The lubricant externally added to the two-component developer was zinc stearate.

Firstly, the first test was to determine whether or not white spot noise occurred.

Figure 7:
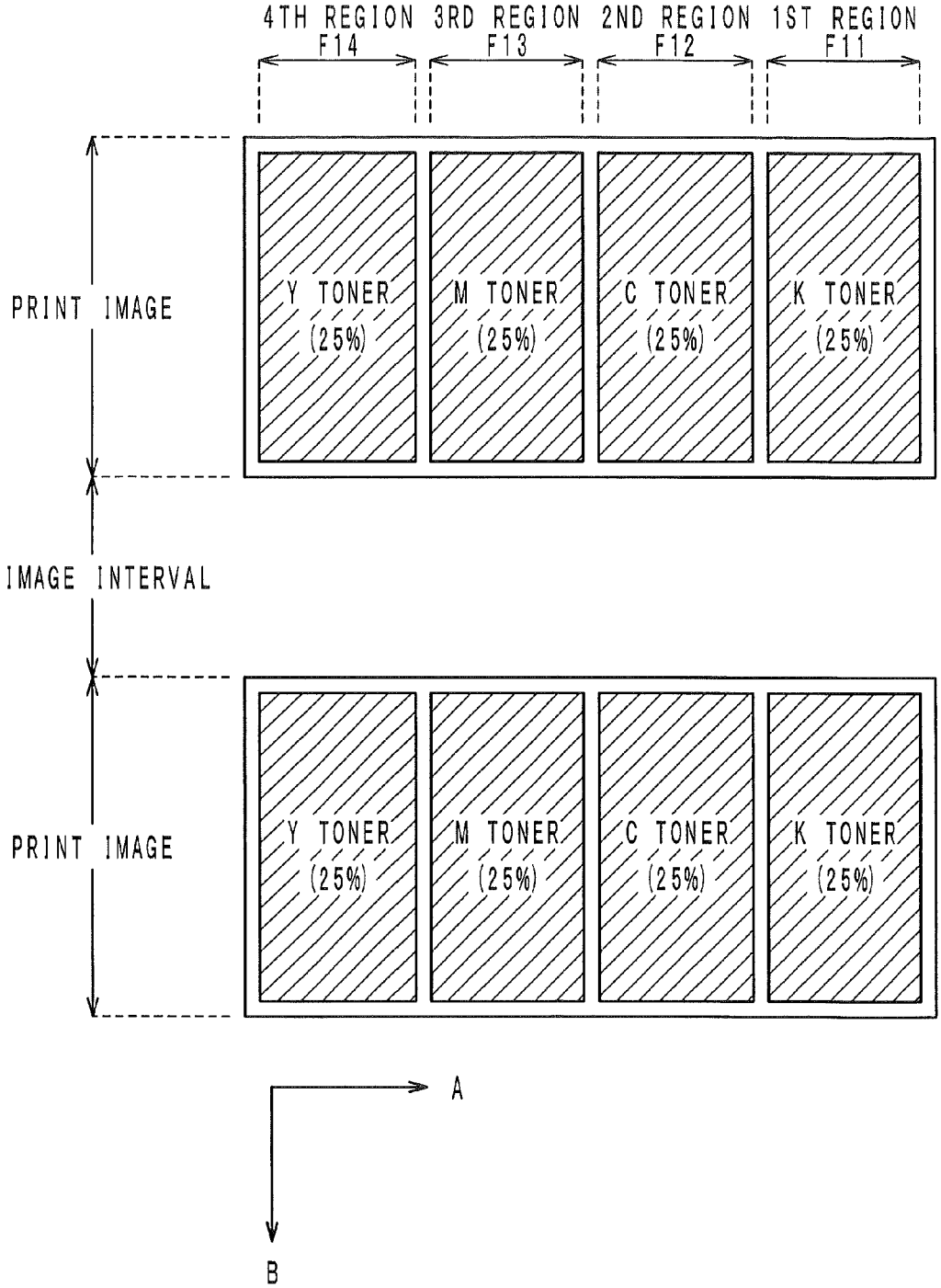
FIG. 7 is a schematic diagram showing an image interval in the case where high-coverage images are continuously printed by a conventional image forming apparatus.

Firstly, FIG. 7 shows an image interval in the case where images whose coverage of each color of YMCK was 25% were continuously printed by a conventional image forming apparatus. In this case, for each color, the images are high-coverage images, and the charge amount of the toner in the developer tank does not decrease. Therefore, a patch image is not formed in the image interval. The inventors of the present application used the conventional image forming apparatus to continuously print the high-coverage images in the A4Y mode on 2000 sheets in a hygrothermal environment of 23° C.×65% RH and thereafter print an entirely-solid image, and then checked whether or not white spot noise occurred. More specifically, the printed entirely-solid image was divided in the main-scanning direction into four regions, and it was checked whether or not white spot noise occurred in the first region F11 to the fourth region F14. The results are shown in Table 7 below.

TABLE 7

Evaluation Results of White Spot Noise by Conventional Apparatus (High Coverage Image)

| Photoreceptor Drum | 1st Region F11 | 2nd Region F12 | 3rd Region F13 | 4th Region F14 |
|---|---|---|---|---|
| Y (most upstream) | ○ | ○ | ○ | ○ |
| M | ○ | ○ | ○ | ○ |
| C | ○ | ○ | ○ | ○ |
| K (most downstream) | ○ | ○ | ○ | ○ |

Evaluation Level ○: No white spot noise occurred
Evaluation Level Δ: Slight white spot noise occurred
Evaluation Level X: Serious white spot noise occurred The second test was as described hereinbelow. A surface analyzer ESCA (ESCALab 200R manufactured by Vacuum Generators) was used to measure the coverage rate of the lubricant coating over the surface of each photoreceptor drum after printing of the entirely-solid image. The lubricant coating coverage rate was calculated by dividing the detected zinc amount on the photoreceptor drum surface after the first test by the detected zinc amount in the lubricant powder which had been measured beforehand. The measurement points of the lubricant coating coverage rate were in the first region F11 to the fourth region F14. The measurement results of the lubricant coating coverage rate at respective measurement points are shown in Table 8.

TABLE 8

Lubricant Coverage Rate by Conventional Apparatus (High Coverage Image)

| Photoreceptor Drum | 1st Region F11 | 2nd Region F12 | 3rd Region F13 | 4th Region F14 |
|---|---|---|---|---|
| Y (most upstream) | 82% | 83% | 82% | 71% |
| M | 83% | 82% | 73% | 80% |
| C | 82% | 73% | 79% | 82% |
| K (most downstream) | 74% | 77% | 82% | 83% |

Figure 8:
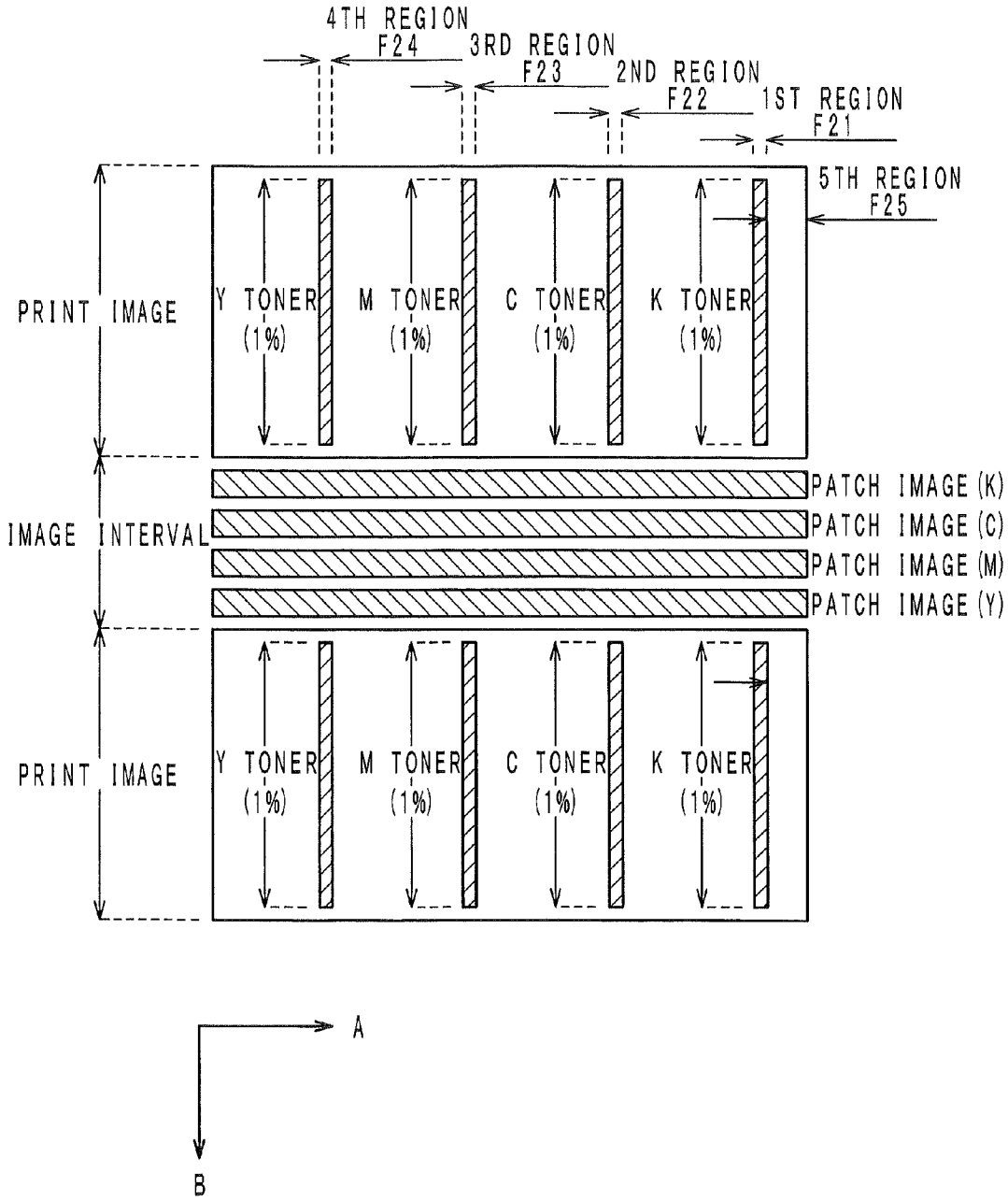
FIG. 8 is a schematic diagram showing an image interval in the case where low-coverage images are continuously printed by a conventional image forming apparatus.

FIG. 8 shows an image interval in the case where images whose coverage of each color was 1% were continuously printed by a conventional image forming apparatus. In this case, for each color, the images are low-coverage images, and there is a probability that the charge amount of the toner in the developer tank decreases. Therefore, patch images whose toner amount is uniform in the main-scanning direction A are formed in the image interval. The inventors of the present application used the conventional image forming apparatus to continuously print the low-coverage images in the A4Y mode on 2000 sheets in a hygrothermal environment of 23° C.×65% RH and thereafter print an entirely-solid image, and then checked whether or not white spot noise occurred. More specifically, in the printed entirely-solid image, regions of the low-coverage image to which the toners of Y, M, C, and K were adhered are referred to as the fourth region F24, the third region F23, the second region F22, and the first region F21, and a region of the low-coverage image to which none of the toners was adhered is referred to as the fifth region F25. The inventors of the present application checked whether or not white spot noise occurred in the first region F21 to the fifth region F25. The results are shown in Table 9 below.

TABLE 9

Evaluation Results of White Spot Noise by Conventional Apparatus (Low Coverage Image)

| Photoreceptor Drum | 1st Region F21 | 2nd Region F22 | 3rd Region F23 | 4th Region F24 | 5th Region F25 |
|---|---|---|---|---|---|
| Y (most upstream) | ○ | ○ | ○ | ○ | ○ |
| M | ○ | ○ | X | ○ | ○ |
| C | ○ | X | X | ○ | ○ |
| K (most downstream) | X | X | X | Δ | X |

Evaluation Level ○: No white spot noise occurred
Evaluation Level Δ: Slight white spot noise occurred
Evaluation Level X: Serious white spot noise occurred The inventors of the present application further measured the coverage rate after printing of the entirely-solid image according to the same procedure as that described above. The measurement points of the lubricant coating coverage rate were in the first region F21 to the fifth region F25. The measurement results of the lubricant coating coverage rate at respective measurement points are shown in Table 10.

TABLE 10

Lubricant Coverage Rate by Conventional Apparatus (Low Coverage Image)

| Photoreceptor Drum | 1st Region F21 | 2nd Region F22 | 3rd Region F23 | 4th Region F24 | 5th Region F25 |
|---|---|---|---|---|---|
| Y (most upstream) | 37% | 40% | 38% | 21% | 37% |
| M | 38% | 38% | 21% | 23% | 40% |
| C | 37% | 22% | 23% | 28% | 40% |
| K (most downstream | 23% | 24% | 28% | 31% | 38% |

As seen from Table 9, serious white spot noise occurred on the photoreceptor drums of the MCK colors (i.e., photoreceptor drums preceded by another photoreceptor drum on the upstream side). Specifically, as for the photoreceptor drum of magenta (M), serious white spot noise occurred in the third region F23 to which the magenta toner adhered. As for the photoreceptor drum of cyan (C), serious white spot noise occurred in the second region F22 and the third region F23 to which the cyan and magenta toners adhered. As for the photoreceptor drum of black (K), serious white spot noise occurred in the first region F21, the second region F22 and the third region F23 to which the black, magenta and cyan toners adhered. As for the photoreceptor drum of black (K), only slight white spot noise occurred in the fourth region F24. This probably means that the reversely transferred toner from the photoreceptor drum of yellow (Y) at the most upstream position has a smaller effect on a photoreceptor drum at a more downstream position.

As seen from Table 10, since low-coverage images were continuously printed, the amount of the lubricant supplied from the developing section was small, and as a result, the lubricant coverage rate was low on the whole as compared with the case of Table 8. The decrease of the lubricant coverage rate was significant particularly in a region in which the adhered toner amount was large (e.g., in the first region F21 to the third region F23 of the photoreceptor drum of black (K)). It was also found from the results of this experiment that white spot noise is more likely to occur when the lubricant coverage rate is generally lower than 30%.

Figure 9:
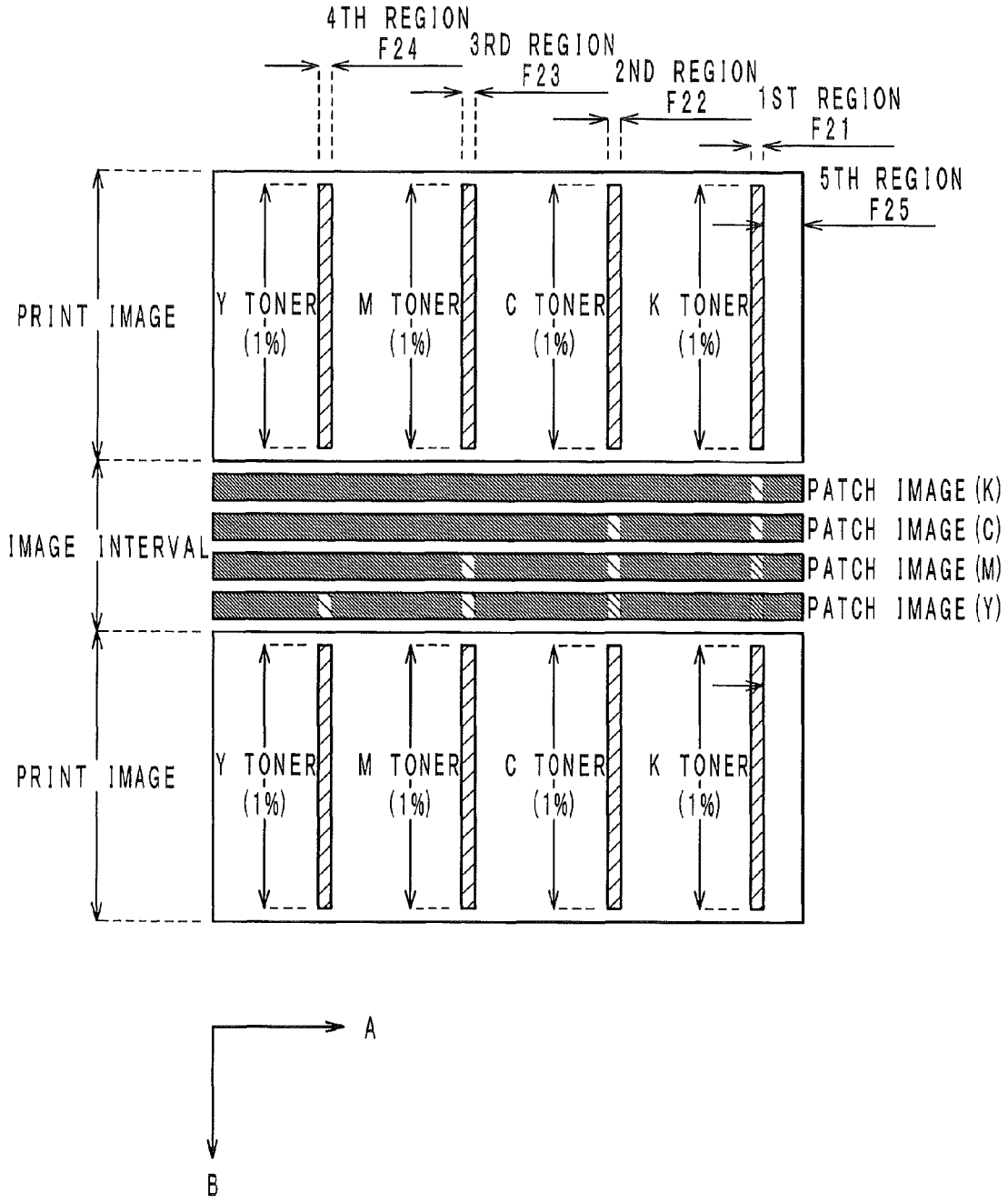
FIG. 9 is a schematic diagram showing an image interval in the case where low-coverage images are continuously printed by the image forming apparatus of FIG. 1.

FIG. 9 shows an image interval in the case where images whose coverage was 1% were continuously printed by the image forming apparatus 1 of the present embodiment. In this case, for respective colors, since the images are low-coverage images, patch images whose toner amount is nonuniform in the main-scanning direction A are formed in the image interval. The inventors of the present application used the image forming apparatus 1 of the present embodiment to continuously print the low-coverage images in the A4Y mode on 2000 sheets in a hygrothermal environment of 23° C.×65% RH and thereafter print an entirely-solid image, and then checked whether or not white spot noise occurred. More specifically, the inventors of the present application checked whether or not white spot noise occurred in the first region F21 to the fifth region F25. The results are shown in Table 11 below.

TABLE 11

Evaluation Results of White Spot Noise by Present Embodiment (Low Coverage Image)

| Photoreceptor Drum | 1st Region F21 | 2nd Region F22 | 3rd Region F23 | 4th Region F24 | 5th Region F25 |
|---|---|---|---|---|---|
| Y (most upstream) | ○ | ○ | ○ | Δ | ○ |
| M | ○ | ○ | ○ | ○ | ○ |
| C | ○ | ○ | ○ | ○ | ○ |
| K (most downstream) | ○ | ○ | ○ | ○ | ○ |

Evaluation Level ○: No white spot noise occurred
Evaluation Level Δ: Slight white spot noise occurred
Evaluation Level X: Serious white spot noise occurred The inventors of the present application further measured the coverage rate after printing of the entirely-solid image according to the same procedure as that described above. The measurement points of the lubricant coating coverage rate were in the first region F21 to the fifth region F25. The measurement results of the lubricant coating coverage rate at respective measurement points are shown in Table 12.

TABLE 12

Lubricant Coverage Rate by Present Embodiment (Low Coverage Image)

| Photoreceptor Drum | 1st Region F21 | 2nd Region F22 | 3rd Region F23 | 4th Region F24 | 5th Region F25 |
|---|---|---|---|---|---|
| Y (most upstream) | 36% | 41% | 37% | 32% | 40% |
| M | 38% | 37% | 32% | 35% | 39% |
| C | 38% | 33% | 36% | 37% | 39% |
| K (most downstream | 33% | 35% | 36% | 38% | 40% |

As seen from Table 11, serious white spot noise did not occur on the photoreceptor drums of the MCK colors (i.e., photoreceptor drums preceded by another photoreceptor drum on the upstream side). This is attributed to patch images of respective colors whose toner amount was nonuniform in the main-scanning direction A. Specifically, in the patch image of magenta (M), the toner supply amount was small in the first region F21 and the second region F22. Thus, in the main-scanning direction A of the photoreceptor drum of magenta (M), the amount of the toner reaching the gap between the photoreceptor drum and the cleaning member is smoothed. As a result, as for the photoreceptor drum of magenta (M), the lubricant coverage rate in the main-scanning direction A is smoothed as seen from Table 12. As seen from the comparison with Table 10, the lubricant coverage rate improves in the first region F21 and the second region F22. Thus, white spots are unlikely to occur on the print image. The same applies to the other colors.

Additional Remarks

In the above-described embodiment, the photoreceptor drums 31*a* to 31*d* are arranged in parallel along a vertical direction, although they may be arranged in parallel along a transverse direction.

In the above-described embodiment, the developing sections 33*a* to 33*d* also function as lubricant supplying sections, although the present invention is not limited to this example. The lubricant supplying sections of respective colors may be provided in the form of lubricant application brushes at positions which oppose the surfaces of the photoreceptor drums 31*a* to 31*d* and which are immediately downstream of the cleaning members 34*a* to 34*d* when viewed in the rotation direction B. In this case, each of the lubricant application brushes rotates to shave the lubricant from a solid lubricant provided around the brush and supply the shaved lubricant to the perimeter surfaces of the photoreceptor drums 31*a* to 31*d*.

Although the present invention has been described in connection with the preferred embodiment above, it is to be noted that various changes and modifications are possible to those who are skilled in the art. Such changes and modifications are to be understood as being within the scope of the invention.

What is claimed is:

1. An image forming apparatus comprising:

a plurality of image supporters arranged in parallel along a predetermined carrying direction, each of the image supporters being rotatable in a sub-scanning direction;

a plurality of chargers configured to charge the plurality of image supporters;

an exposure section configured to scan the plurality of image supporters with an optical beam modulated according to image data that represents a print image in a main-scanning direction that is generally perpendicular to the sub-scanning direction, thereby forming a latent image;

a plurality of developing sections configured to supply a toner to the plurality of image supporters to form toner images;

a plurality of lubricant supplying sections configured to supply a lubricant to the plurality of image supporters;

an intermediate transfer medium extending in the carrying direction, to which the toner images formed on the plurality of image supporters are transferred such that the toner images are superposed on one another;

a plurality of cleaning members configured to remove a transfer residual toner remaining on the plurality of image supporters after the transfer of the toner images to the intermediate transfer medium; and a control section configured to control formation of the toner images that represent the print image, wherein when some of the plurality of image supporters which are preceded by another image supporter on an upstream side of the carrying direction are referred to as downstream side image supporters, the control section further derives a toner supply amount for each of positions in the main-scanning direction for each of the downstream side image supporters based on image data for the downstream side image supporters and image data for an upstream side image supporter, and thereafter generates patch image data that represents the derived toner supply amount, and the exposure section further scans each of the downstream side image supporters in the main-scanning direction with an optical beam modulated according to the patch image data generated by the control section.

2. The image forming apparatus according to claim 1, wherein the control section includes a first deriving section configured to derive an adhered toner amount for each of the positions in the main-scanning direction for each of the plurality of image supporters for the print image, a second deriving section configured to derive an amount of a reversely transferred toner from an upstream side image supporter for each of the positions in the main-scanning direction for each of the downstream side image supporters, and a data generation section configured to derive a toner supply amount for each of the positions in the main-scanning direction for each of the downstream side image supporters based on the adhered toner amount derived by the first deriving section and the reversely transferred toner amount derived by the second deriving section, and thereafter generating patch image data that represents the derived toner supply amount.

3. The image forming apparatus according to claim 2, wherein the first deriving section integrates an adhered toner amount in the sub-scanning direction for each of the positions in the main-scanning direction.

4. The image forming apparatus according to claim 2, wherein the data generation section subtracts the adhered toner amount derived by the first deriving section from a predetermined reference toner amount for each of the positions in the main-scanning direction, thereby deriving a toner supply amount for each of corresponding positions in the main-scanning direction.

5. The image forming apparatus according to claim 2, wherein the data generation section subtracts a sum of the adhered toner amount derived by the first deriving section and the reversely transferred toner amount derived by the second deriving section from a predetermined reference toner amount for each of the positions in the main-scanning direction, thereby deriving a toner supply amount for each of corresponding positions in the main-scanning direction.

* * * * *